US007325695B2

(12) United States Patent
Yang et al.

(10) Patent No.: US 7,325,695 B2
(45) Date of Patent: Feb. 5, 2008

(54) DISH RACK WITH WATER DRAINAGE MECHANISM

(75) Inventors: Frank Yang, Rancho Palos Verdes, CA (US); Myk Wayne Lum, Irvine, CA (US); Tzu-Hao Wei, Hacienda Heights, CA (US)

(73) Assignee: Simplehuman LLC, Torrance, CA (US)

( * ) Notice: Subject to any disclaimer, the term of this patent is extended or adjusted under 35 U.S.C. 154(b) by 114 days.

(21) Appl. No.: 11/157,302

(22) Filed: Jun. 20, 2005

(65) Prior Publication Data

US 2006/0283817 A1 Dec. 21, 2006

(51) Int. Cl.
*A47G 19/08* (2006.01)

(52) U.S. Cl. ..... 211/41.3; 211/41.3; 211/41.4; 211/41.2; 211/85.25

(58) Field of Classification Search ..... 211/41.3, 211/41.4, 41.1, 41.2, 85.25, 41.5, 41.6, 41.8; D32/55, 56; 220/572, 487; 4/654, 656; 134/200, 201
See application file for complete search history.

(56) References Cited

U.S. PATENT DOCUMENTS

| | | | | | |
|---|---|---|---|---|---|
| 63,361 | A | * | 4/1867 | Bucknam | 211/41.3 |
| 124,085 | A | * | 2/1872 | Richmond | 211/41.3 |
| 497,673 | A | * | 5/1893 | Lyle | 220/572 |
| 591,377 | A | * | 10/1897 | Bunce | 220/572 |
| 2,936,898 | A | * | 5/1960 | Miguez | 211/41.3 |
| D221,678 | S | * | 8/1971 | Gottsegen | D32/55 |
| 4,531,641 | A | * | 7/1985 | Archambault | 211/41.3 |
| D306,926 | S | | 3/1990 | Heller et al. | |
| 5,119,943 | A | * | 6/1992 | Hoang | 211/41.3 |
| D347,717 | S | * | 6/1994 | Chapin | D32/55 |
| D353,921 | S | | 12/1994 | Lippisch et al. | |
| D363,578 | S | | 10/1995 | Brightbill et al. | |
| 5,588,539 | A | | 12/1996 | Belden, Jr. et al. | |
| D397,534 | S | * | 8/1998 | Alvarez | D32/55 |
| D398,725 | S | | 9/1998 | Merkel | |
| D408,603 | S | | 4/1999 | Haley | |
| 6,179,134 | B1 | * | 1/2001 | Pine et al. | 211/41.3 |
| D439,716 | S | | 3/2001 | Wright | |
| D446,369 | S | * | 8/2001 | Smith et al. | D32/55 |
| D446,370 | S | * | 8/2001 | Avila Adikimenakis et al. | D32/56 |
| D448,132 | S | | 9/2001 | Wolfenden | |
| 6,364,130 | B2 | | 4/2002 | Wright | |
| 6,491,170 | B1 | * | 12/2002 | Madela | 211/41.3 |
| 2004/0238464 | A1 | * | 12/2004 | Cheung | 211/41.3 |

* cited by examiner

*Primary Examiner*—Kambiz Abdi
*Assistant Examiner*—Lindsay M. Maguire
(74) *Attorney, Agent, or Firm*—Raymond Sun

(57) ABSTRACT

A dish rack has a rack portion having a tray, the tray having an opening. The dish rack also includes a ramp provided below the tray and positioned to receive water that flows through the opening of the tray. The ramp has a front end, a rear end, and a water outlet provided at the front end, the ramp being angled so that water flows from the rear end to the front end and then through the water outlet.

5 Claims, 6 Drawing Sheets

DISH RACK WITH WATER DRAINAGE MECHANISM

BACKGROUND OF THE INVENTION

1. Field of the Invention

The present invention relates to dish racks, and in particular, to a dish rack that can be used both adjacent, and inside, a kitchen sink.

2. Description of the Prior Art

Dish racks are commonly used on kitchen countertops for positioning plates, bowls, cups and utensils to let them dry after they have been washed. The water from the washed plates, bowls, cups and utensils will typically drip on to the base or tray of the dish rack, and the water can be drained to the kitchen sink by tilting the base. In addition, the drip trays are sometimes used to hold or house plates, bowls and similar items. Thus, these drip trays serve a dual purpose: to hold/house these items, and to drain water.

Unfortunately, these conventional dish racks suffer from several drawbacks. First, they lack an effective way of draining the water collected on the base to the kitchen sink. Tilting the base can be difficult (and dangerous) if the dish rack is fully loaded with dishes, bowls, utensils and other items.

Second, the conventional dish racks are typically positioned on a countertop adjacent the kitchen sink. Unfortunately, if the dish rack is inadvertently pushed or rattled (e.g., by a user, a child or a pet), the water that has collected on the base may be splashed out of the base on to the countertop or the floor.

Thus, there remains a need for a dish rack that overcomes the drawbacks identified above.

SUMMARY OF THE DISCLOSURE

It is an object of the present invention to provide a dish rack that effectively drains water that has been collected on a base or a tray.

It is another object of the present invention to provide a dish rack that is sized and configured to be placed inside a conventional kitchen sink.

In order to accomplish the objects of the present invention, the present invention provides a dish rack having a rack portion. The rack portion has a tray that has an opening. The dish rack also includes a ramp provided below the tray and positioned to receive water that flows through the opening of the tray. The ramp has a front end, a rear end, and a water outlet provided at the front end, the ramp being angled so that water flows from the rear end to the front end and then through the water outlet.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
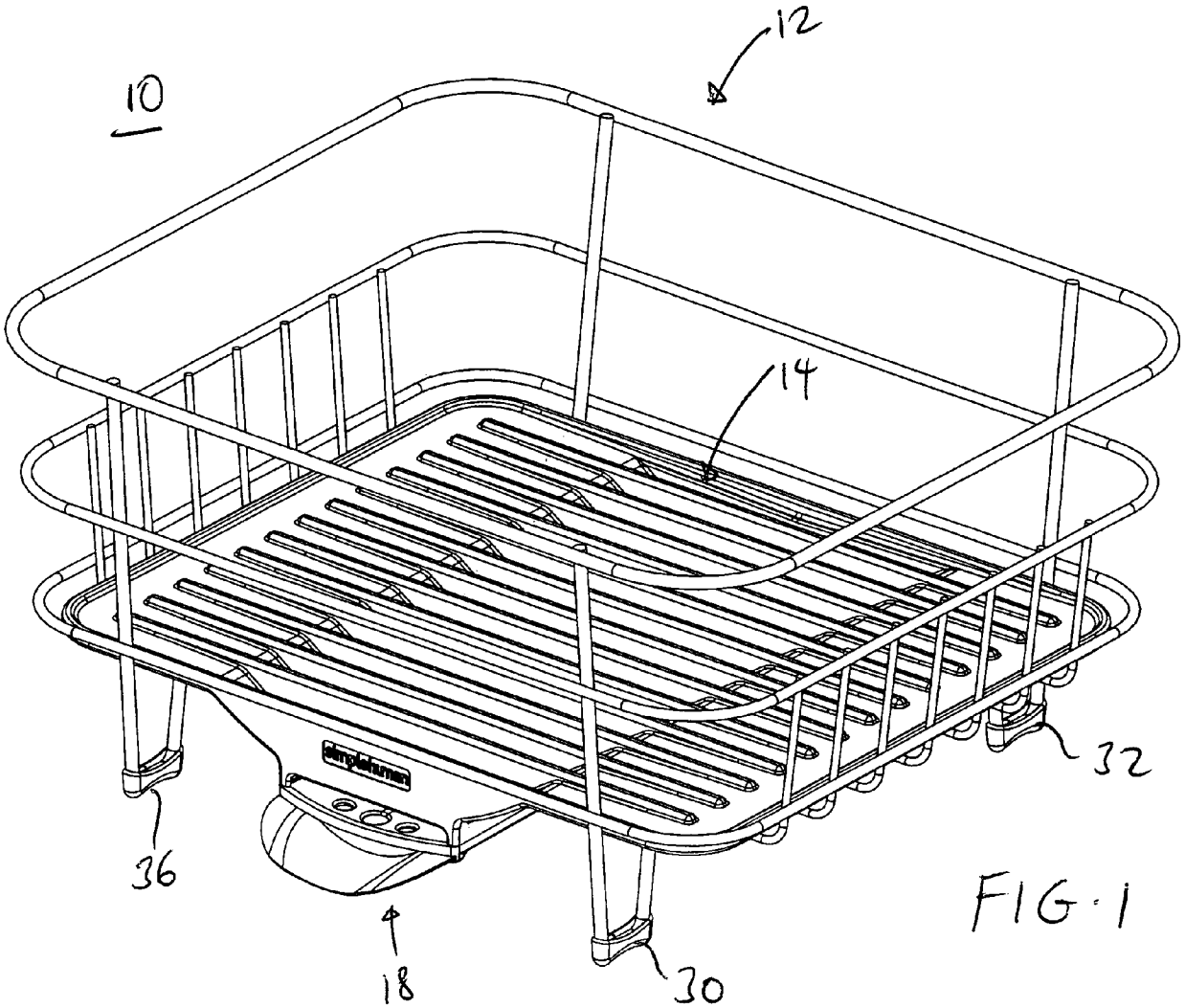
FIG. 1 is a perspective view of a dish rack according to one embodiment of the present invention.
Figure 2:
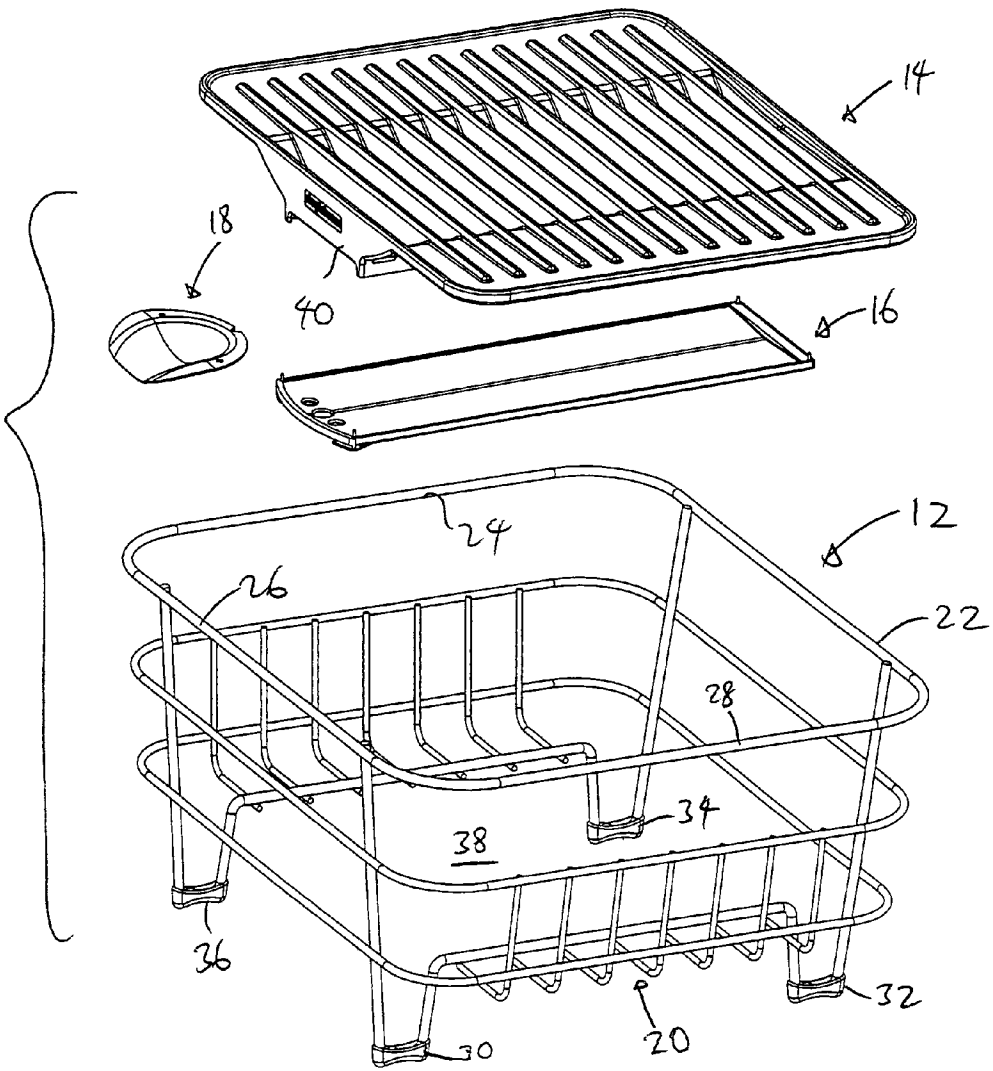
FIG. 2 is an exploded perspective view of the dish rack of FIG. 1.

FIGS. 1-2 illustrate a dish rack 10 having a generally four-sided (e.g., square, rectangular) configuration. The dish rack 10 includes a wire frame 12, a tray 14, a ramp 16 and a spout 18. The wire frame 12 acts as a rack portion, and can be made of a metal wire frame that includes a wire frame base 20 and four wire frame walls 22, 24, 26, 28. Four legs 30, 32, 34, 36 are formed from the wire frame 12 and function to elevate the wire frame base 20 so that a trough 40 and the ramp 16 can be fitted below the wire frame base 20. The wire frame base 20 defines an opening 38 for receiving the central trough 40 of the tray 14.

Figure 3:
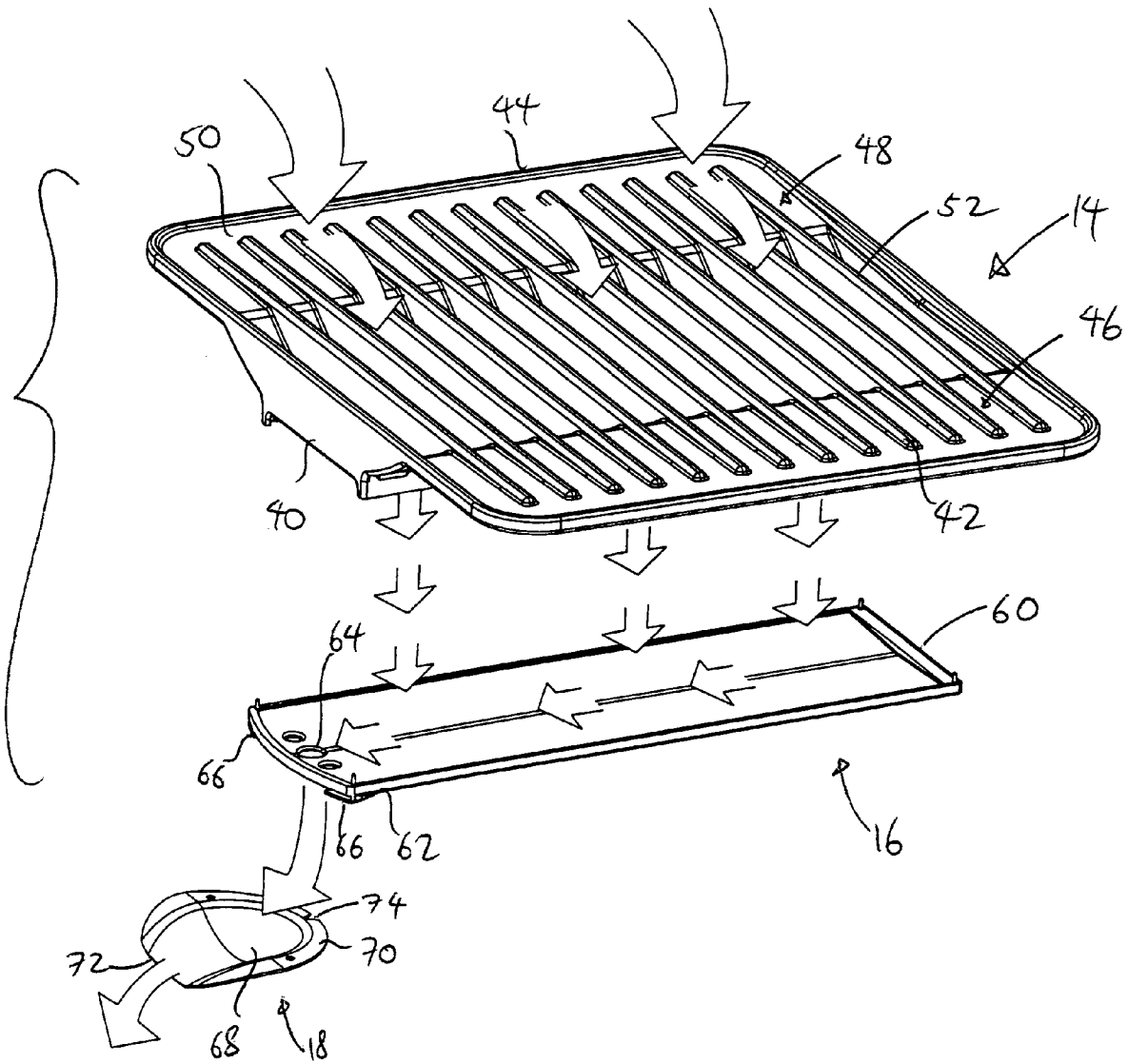
FIG. 3 is an exploded perspective view of the tray of the dish rack of FIG. 1 illustrating the flow of water therefrom.
Figures 5A, 5B:
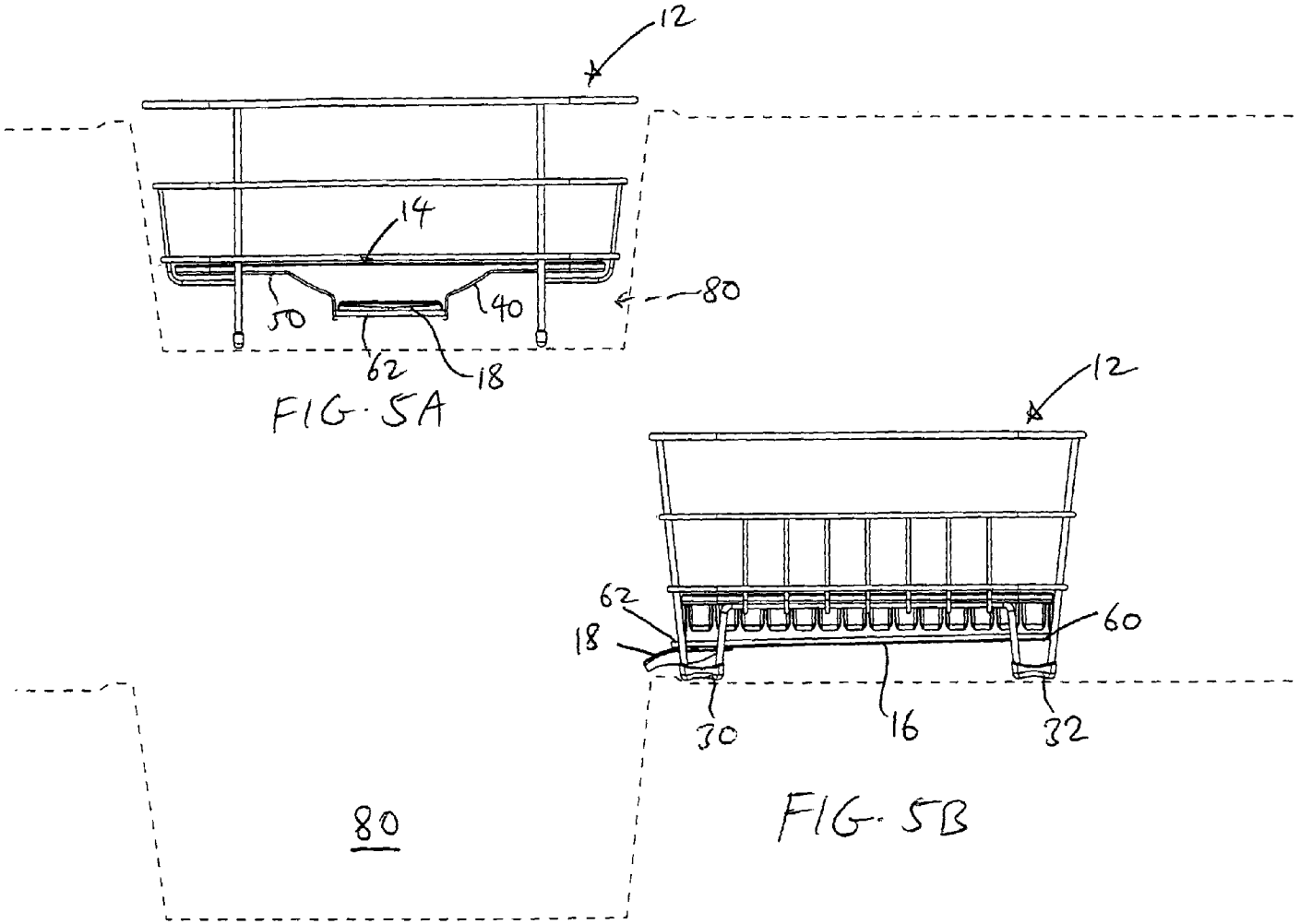
FIG. 5A is a side plan view illustrating the dish rack of FIG. 1 positioned inside a kitchen sink.
FIG. 5B is a side plan view illustrating the dish rack of FIG. 1 positioned on a countertop adjacent a kitchen sink.

Referring also to FIGS. 3, 5A and 5B, the tray 14 is also provided in the same four-sided configuration of the wire frame 12, and is adapted to be rested on top of the wire frame base 20. The tray 14 has a plurality of dividing ridges 42 provided on a plate 50, with the dividing ridges 42 functioning as dividers for receiving plates and similar items. A peripheral ridge 44 extends around the four sides of the tray 14, so that channels (e.g., 46, 48) are defined between the ridges 42 and 44. A central trough 40 extends downwardly from the center of the plate 50, with a dividing wall 52 extending into the trough 40 from each set of dividing ridges 42. These dividing walls 52 are effective in holding bowls, plates or other similar items while these items are laid flat. The trough 40 defines an elongated opening. The plate 50 is slanted or angled towards the trough 40 so that water collected on the plate 50 will be guided by the dividing ridges 42 along the channels 46, 48 to flow into the trough 40.

A ramp 16 is attached to the bottom of the trough 40 so that all the water flowing through the trough 40 is collected on the ramp 16. The ramp 16 has a generally concave cross-section (see FIG. 3), and is angled so that the ramp 16 gradually decreases in height from a rear end 60 to a front end 62 (see FIG. 5B). One or more water outlets 64 are provided at the front end 62. A pair of opposing rails 66 are provided at the bottom of the ramp 16 adjacent the front end 62 thereof.

A spout 18 can be removably secured to the plurality of outlets 64. Referring to FIG. 3, the spout 18 has a concave body 68 that is surrounded by a generally U-shaped border plate 70 and a straight edge 72. A V-shaped notch 74 is provided at the center of the U-shape of the border plate 70. The concave body 68 is angled so that water from the outlets 64 can flow down the concave body 68 from the border plate 70 (adjacent the notch 74) towards the straight edge 72 where the water can be flowed into a kitchen sink 80. The border plate 70 is sized and configured to slide into the opposing rails 66 at the bottom of the ramp 16 to removably secure the spout 18 adjacent the water outlets 64. To disengage the spout 18 from a front end 62, the user merely grips the concave body 68 and pulls the spout 18 from the rails 66.

Figure 6:
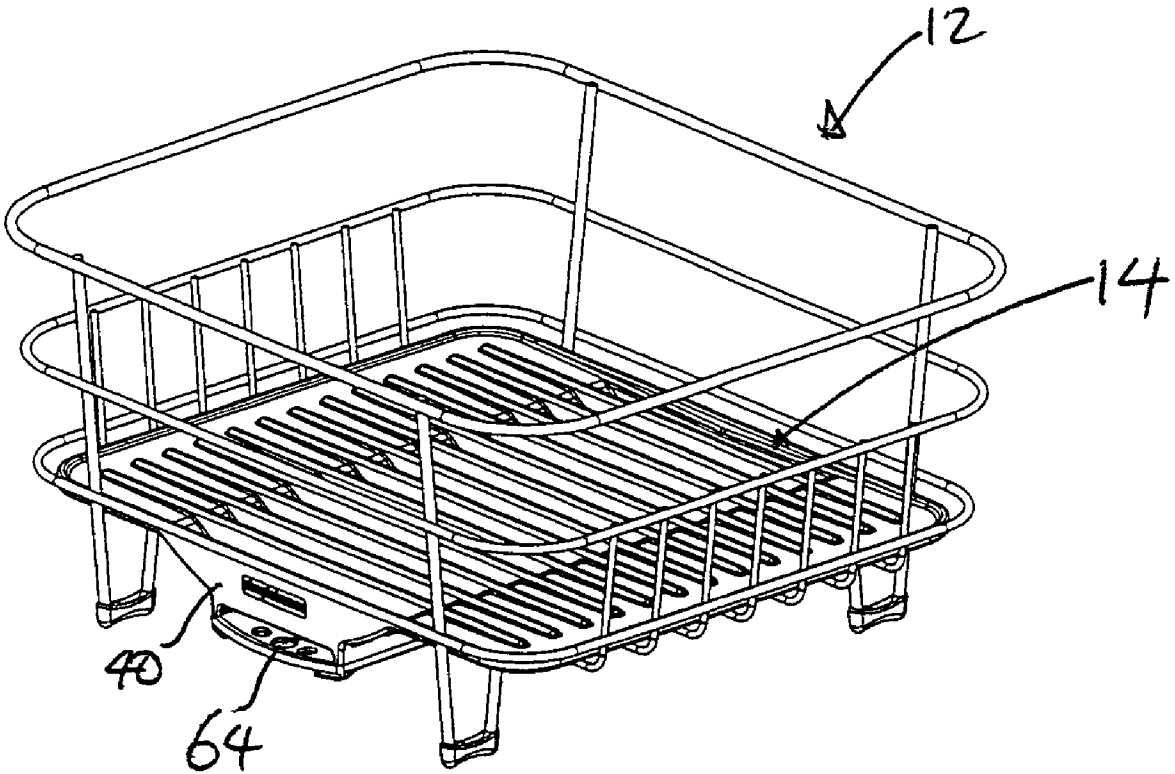
FIG. 6 is a perspective view of the dish rack of FIG. 1 with the spout removed.

The spout 18 is entirely optional and merely assists in channeling the water on the ramp 16 into the kitchen sink. The spout 40 can be omitted, as best shown in FIG. 6, such that the water on the ramp 16 will flow through the water outlets 64 directly to the kitchen sink. For example, the spout 18 is preferably removed when the dish rack 10 is deployed inside a kitchen sink 80, as described below.

In use, the ramp 16 is secured to the bottom of the trough 40 of the tray 14. The spout 18 can be secured to the front end 62 of the ramp 16 by sliding the border plate 70 into the rails 66. The tray 14 (together with the ramp 16 and spout 18) is then placed inside the wire frame 12 at the location of the opening 38, as shown in FIG. 2.

Figures 4A, 4B:
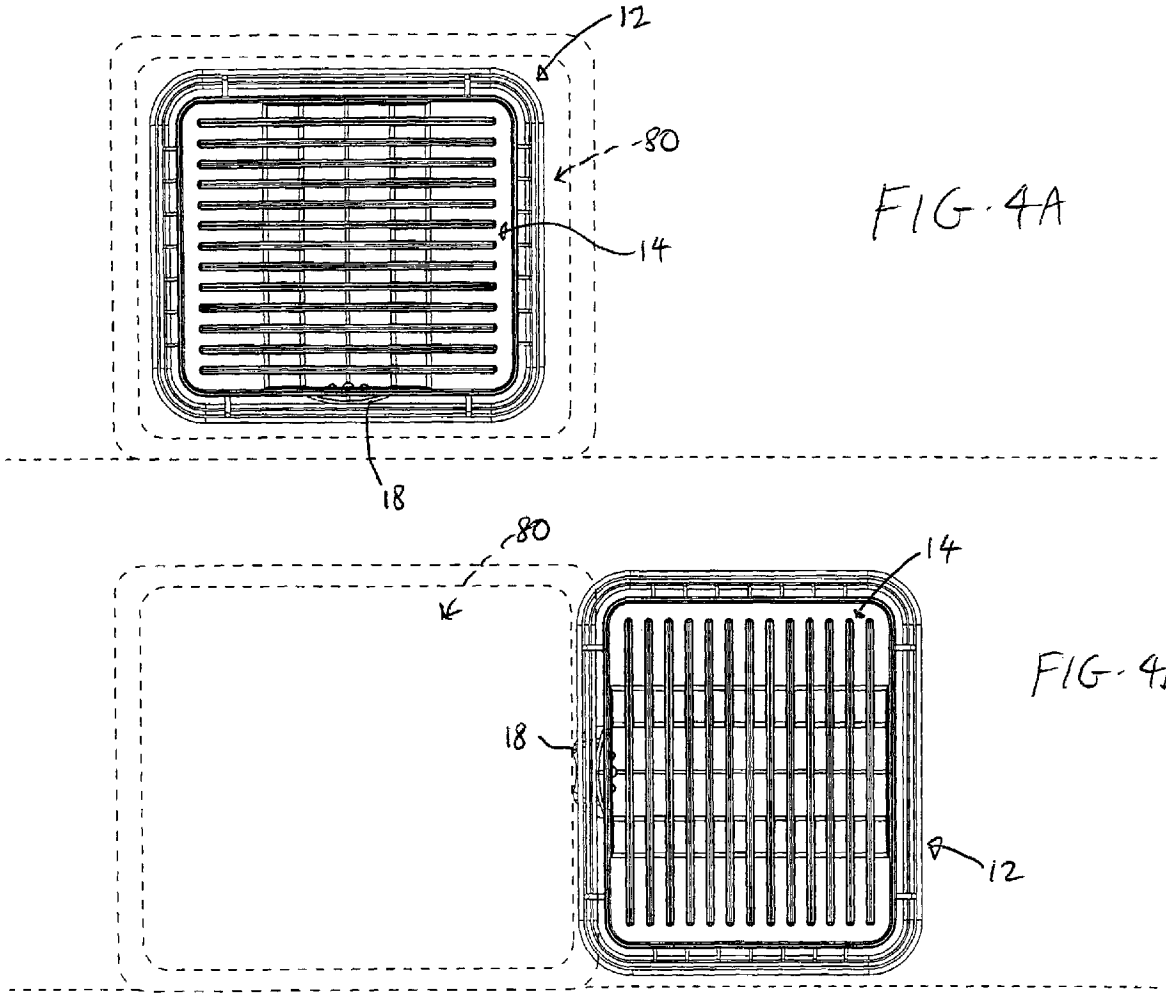
FIG. 4A is a top plan view illustrating the dish rack of FIG. 1 positioned inside a kitchen sink.
FIG. 4B is a top plan view illustrating the dish rack of FIG. 1 positioned on a countertop adjacent a kitchen sink.

The dish rack 10 is sized and configured so that it can be placed inside a conventional kitchen sink 80, as best shown in FIGS. 4A and 5A. With the dish rack 10 placed inside a kitchen sink 80, the user can place washed dishes and other items on to the tray 14, and the water from the washed dishes and other items will flow down the plate 50, through the trough 40, down the ramp 16 towards the front end 62 thereof, and then through the water outlets 64 to be drained into the kitchen sink 80.

Alternatively, the dish rack 10 can be placed adjacent a conventional kitchen sink 80 with the water outlets 64 (and spout 18) facing the kitchen sink 80, as best shown in FIGS. 4B and 5B. The user can place washed dishes and other items on to the tray 14, and the water from the washed dishes and other items will flow down the plate 50, through the trough 40, down the ramp 16 towards the front end 62 thereof, and then through the water outlets 64 to be drained by the spout 18 into the kitchen sink 80. If the spout 18 is omitted, the water can be drained directly from the water outlets 64 to the kitchen sink 64.

Although the present invention illustrates the dish rack 10 as being made of a metal wire frame, the principles of the present invention can be applied to any dish rack, including dish racks made of plastic or other material, or other construction.

Thus, the tray 14, the trough 40 and the ramp 16 provide a simple construction for facilitating the effective and clean drainage of water from the tray 14 to the kitchen sink 80. In addition, by sizing and configuring the dish rack 10 so that it can be placed inside a conventional kitchen sink 80, the dish rack 10 can be placed inside the kitchen sink 80 to save countertop space, and to prevent the inadvertent pushing of the dish rack 10 when it is placed on a countertop.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A dish rack, comprising:

a wire frame having a wire frame base;

a tray having a bottom and an opening provided in the bottom of the tray, the tray seated on the base of the wire frame;

a ramp provided below the bottom of the tray and positioned to receive water that flows through the opening of the tray, the ramp having a front end, a rear end, and a water outlet provided at the front end, the ramp being angled so that water flows from the rear end to the front end and then through the water outlet;

an opening provided in the base, and with the tray seated on the base over the opening of the base; and a spout removably coupled to the front end of the ramp.

2. The dish rack of claim 1, wherein the tray has a trough provided at the opening.

3. The dish rack of claim 1, wherein the tray is angled so that water on the tray flows towards the opening.

4. The dish rack of claim 1, wherein the wire frame includes a plurality of legs.

5. The dish rack of claim 1, wherein the tray includes a plurality of dividing ridges.

* * * * *